United States Patent [19]

Asfour

[11] Patent Number: 4,785,510

[45] Date of Patent: Nov. 22, 1988

[54] METHOD AND APPARATUS FOR THE CONTINUOUS LOOPING OF YARN

[75] Inventor: Emil Asfour, Herrliberg, Switzerland

[73] Assignee: G & W Maschinen AG, Wetzikon, Switzerland

[21] Appl. No.: 49,726

[22] Filed: May 12, 1987

[30] Foreign Application Priority Data

May 13, 1986 [CH] Switzerland ..... 01934/86

[51] Int. Cl.[4] ..... B65H 54/82

[52] U.S. Cl. ..... 28/289; 19/159 R; 242/47.01; 242/82

[58] Field of Search ..... 28/257, 281, 289; 19/159 R; 242/47, 47.01, 82

[56] References Cited

U.S. PATENT DOCUMENTS

| | | | |
|---|---|---|---|
| 2,983,967 | 5/1961 | West et al. | 19/159 R |
| 3,032,832 | 5/1962 | Dudley | 19/159 R |
| 3,226,794 | 1/1966 | Erb | 28/289 X |
| 3,318,013 | 5/1967 | Erb | 28/281 X |
| 3,478,399 | 11/1969 | Wyatt et al. | 28/289 X |
| 3,672,819 | 6/1972 | Katsuyama et al. | 28/257 X |
| 4,392,286 | 7/1983 | Yakushiji et al. | 28/289 |

FOREIGN PATENT DOCUMENTS

| | | | |
|---|---|---|---|
| 1909738 | 9/1969 | Fed. Rep. of Germany | 28/289 |
| 1602027 | 11/1970 | France | 28/289 |
| 4640515 | 11/1971 | Japan | 28/281 |
| 483866 | 2/1973 | Japan | 28/281 |

*Primary Examiner*—Robert R. Mackey
*Attorney, Agent, or Firm*—Bauer & Schaffer

[57] ABSTRACT

A fixed base plate provided with a circular recess accommodates a rotating disk. Mounted above the base plate and the rotating disk, is an endless band conveyor swivellable about the axis of the roller in the area of the edge of the base plate. The rotating disk is fitted with a channel through which the yarn is guided from below into the space between the disk and the lower run of the band conveyor in which loops are formed and moved toward the edge of the base plate. Arranged at the edge of the base plate, below the conveyor, is a belt, receiving the loops. The drives of the band conveyor and the belt conveyor form a single unit.

11 Claims, 2 Drawing Sheets

METHOD AND APPARATUS FOR THE CONTINUOUS LOOPING OF YARN

BACKGROUND OF THE INVENTION

The present invention relates to an apparatus for the production and delivery of a continuous stream of yarn loops.

In the early stages of the manufacture of yarn, the yarn may be treated in several ways which require the yarn to be fed in a series of untensioned loops, as for example, to a steam chamber for stabilization. A device for looping yarn is known from the German unexamined patent specification OS No. 3 114 535. In this known device, the yarn is wound by a rotating lapping wing on a coil former and transferred by the latter to a band conveyor. The axis of the coil former runs vertically to the axis of rotation of the lapping wing and to the running direction of the band conveyor. The coil former itself is formed of two circular disks spaced apart on this axis. Arranged on the circumference of these disks are adhesion surfaces on which the yarn is placed by means of the lapping wing. To produce yarn loops, the coil former is rotated about its axis, while the lapping wing rotates simultaneously thereabout. The yarn carried along by the lapping wing is hereby laid continuously loop by loop on the jacket of the coil former about its axis, these loops are turned by about 90 degrees and then deposited by a stripping device on the band conveyor, providing a continuous series of yarn loops. As a result of the turning of the loops on the coil former, the loops produced first in this loop band lie in front and on top.

To start this device, the end of the yarn must be held fast until so many loops have been formed on the coil former, that they act to clamp each other on the coil former. This holding of the beginning of the yarn is usually done by hand, causing considerable difficulty in machines equipped with several such devices arranged next to each other. The beginning of the yarn can also be clamped by mechanical means and released after a certain period which, however, would make the construction of the machine expensive and prone to disruptions. An additional disadvantage is that the yarn is tensioned and stretched as a result of the lapping process on the coil former.

The present invention has as its object, the task of producing a device wherein starting of the loop forming is a simple and automatic operation, and wherein the yarn is laid out in loops without being stretched, and specifically in such a way that it can be removed upwardly from the band conveyor, and wherein the device is of simple construction.

These objects, as well as other objects, will be apparent from the following disclosure of the present invention.

SUMMARY OF THE INVENTION

In accordance with the present invention, apparatus for the continuous looping of yarn and the supply of such looped yarn is provided comprising a fixed base plate having an upper planar surface and recess formed therein. A revolving disk is arranged with its upper surface co-planar with that of the fixed plate and having a feed channel extending from its lower surface to the upper surface, in a direction toward the periphery of the disk. A first endless linear conveyor having a width at least equal to the diameter of the revolving disk is mounted above the base plate to gravitationally rest with its front end on the upper surface of the base plate. The first linear conveyor moves across the revolving disk to cooperate therewith to receive the yarn and form an endless series of loops in the space therebetween. The first conveyor extends at least to the peripheral edge of said base plate and at least in part, above a second linear conveyor extending from the periphery of the base plate parallel to the first conveyor to remove the loops.

The apparatus provides a simple and functionally safe form of construction for the formation and delivery of an endless series of loops, lying successively one below and behind the proceeding loops. The yarn is looped on the surface of the revolving disk in slack loops, as no additional devices are required for clamping or stretching of the yarn during its feeding to the rotating disk.

Preferably, the apparatus includes a yarn feed device including a compressed air transport so as to feed the yarn to the rotating disk loosely and without stress or tension. The first and second linear conveyors are preferably belt or band conveyors, arranged with their lines of movement in the same direction and driven at the same speed so that transfer of the loops from the flat fixed plate to the second conveyor is made without dislocating the relative orientation of the series of loops.

Full details of the present invention are set forth in the following description and are illustrated in the accompanying drawings.

DESCRIPTION OF THE INVENTION

Figure 1:
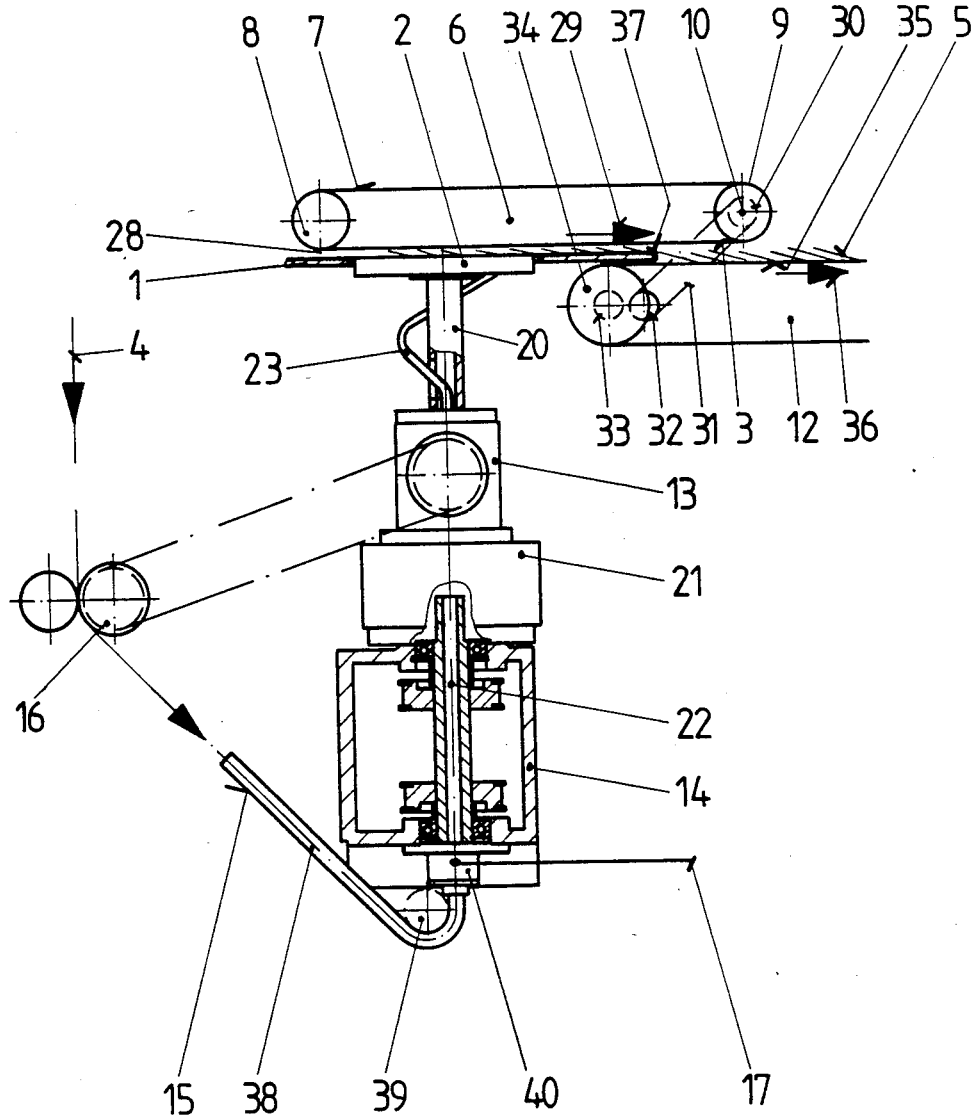
FIG. 1 is a sectional view of a yarn looping and delivering apparatus incorporating the present invention.
Figure 2:
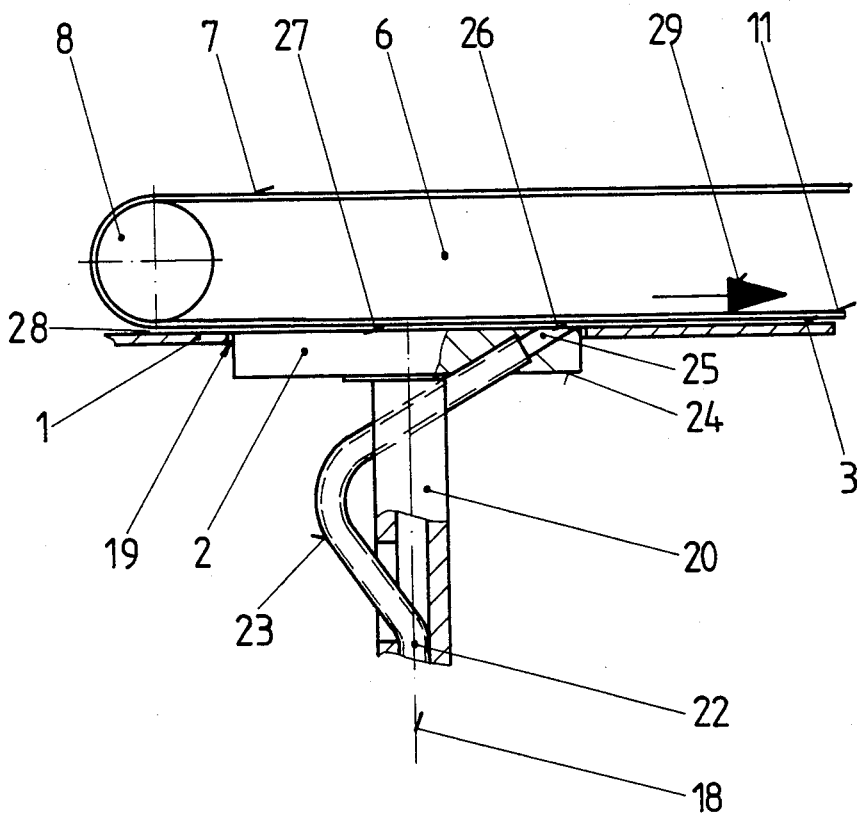
FIG. 2 is an enlarged section of the apparatus shown in FIG. 1.

The apparatus embodying the present invention, as illustrated in FIGS. 1 and 2, comprises a fixed base plate 1, forming a flat table surface, a rotating or revolving disk 2, the upper surface of which forms a looping surface 27, a cooperating first linear conveyor 6 and a second linear conveyor 12 for the removal of the formed loops.

Located below the fixed base plate 1 is a drive unit 13, a bearing housing 14, a yarn feed device 15 having a yarn drive 39 and an air transport device 17. The revolving disk 2, rotatable about an axis 18, is arranged in a circular recess 19 formed in the fixed base plate 1, and is mounted at the end of a hollow drive shaft 20, coupled to the drive unit 13. Journalled below the drive unit 13 itself is the bearing housing 14, at the upper end of which is arranged a braking and coupling assembly 21. A helically curved hollow tube 23 extends from the inner bore 22 of the hollow drive shaft 20 above the drive unit 13, to wind about the drive shaft 20 and enter, via the lower surface 24 of the revolving disk 2, into a channel 25, passing through the revolving disk 2. The channel 25 passes angularly toward the periphery of the disk 2, to open at 26 on the upper surface 27 of the revolving disk 2. The hollow drive shaft 22, the intermediate piece 23, and the channel 25 in the disk 2, form part of the overall yarn feed 15.

The cooperating loop forming first linear conveyor 6 consists of an endless circulating belt 7 running over two rollers 8 and 9 having a width at least equal to the diameter of the revolving disk 2. The entire conveyor 6 is pivotally mounted about the axis 10 of the roller 9 so that it hangs by its own weight and can be swivelled with respect to the base plate 1. The roller 9 is provided with a drive gear 30 connected by way of a toothed transmission belt 31 with an intermediate gear 32 which is driven by a drive gear 33. The drive gear 33 is fixed on the axis of a roller 34 about which a band 35 forming the second band conveyor 12 for removing the loops, is also rotated. This connection ensues that the band 35 and the belt 7 rotate at exactly the same speed. This construction furthermore assures that the parts of the belts 7 and 35 are oriented towards the fixed base plate 1, and run in the same direction, as shown by the arrows 29 and 36, respectively, i.e. in the same linear direction.

In referring to the conveyers 6 and 12, repectively, the conveyor 6 is said to comprise a belt 7, while the conveyor 12 comprises a band 35. These references are for convenience only so as to clearly distinguish between the two. It will be apparent that these elements are interchangeable bands or equivalent endless conveyor means.

The lower run 11 of the belt 7 of the cooperating looping first linear conveyor 6, extends beyond the fixed base plate 1, forming an area 3 overlapping the upper run of the band 35 so that the yarn loops 5, formed by cooperation of the belt 7 and the revolving disk 2 are transferred in the direction 29, 36 from the peripheral edge 37 of the base plate on to the band 35. In order to permit the yarn loops 5 to be formed between the revolving disk 2 and the lower run 11 of the cooperating first linear conveyor 6, on the one hand, and to be collected one under the other in the area 3, on the other hand, the entire first linear conveyor 6, is pivoted at the axis 10 so as to swivel relative to the base plate 1 to provide a variable space 28 between the belt 7 and disk 6 in which the yarn is looped by cooperation of the revolving disk 2 and the linear moving run 11 of the belt 7.

The endless feed yarn 4 is delivered to the looping apparatus, for instance, from any preceding mechanism, (not shown) in the drawing, on which the yarn strand is stretched and tensioned. The yarn 4 is guided into a yarn drive 16 by way of conventional guide rollers, tensioning device and additional guide rollers (not shown). The yarn drive 16 transports the yarn 4 into a guide tube 38 and by way of the deflection pulley 39, passing through the wall of the guide tube 38, is pushed into the air intake 40 of a pneumatic feed device 17, the latter then blowing the yarn 4 tension-free upward through the bore 22 of the hollow drive shaft 20 and through the helical intermediate piece 23 into the channel 25 passing through the disk 2. At the upper surface 27 of the revolving disk 2, the yarn exits through the hole 26 into the space 28. Since the disk 2 and thus the hole 26 rotate about the axis 18, the yarn 4 is rolled in a circular shape in the space 28 moving forwardly, at the same time into the area 3 below the lower run 11 of the belt 7.

As a result of the relative movement between the revolving disk 2 and the lower run 11 of the belt 7, a series of yarn loops 5 is continuously formed and laid out. New loops 5 of the yarn 4 are formed continuously by means of the revolving disk 2 and are added (shuffled) below the preceeding formed loops 5, the first formed loop lying always on top and the succeedingly formed loops shuffled serial by below each other. Thus, the yarn 4 can be pulled off from its beginning in an upward direction without disruption of the succeeding series of the loops, preferably after passing through a steaming station or other treatment station, not shown in the drawing.

Depending on the thickness of the yarn 4, the upper continuous conveyor 6 is lifted off more or less from the base plate so as to adjust the space 28 in which the looping occurs. This adjustment is automatic, since the conveyor 6 swivels easily about the axis 10 and falls only through gravitational pull by its own weight. By changing the speed of rotation of the belt 7, in relation to the speed of the revolving disk 2, the staggering or spacing of the individual yarn loops 5 with respect to each other can be controlled, permitting in a simple manner the creation of optimal conditions for delivery to the band 35 and the subsequent after-treatment stations.

The lower band conveyor 12 begins in the area of the edge 37 of the base plate 1 where it receives the yarn loops 5. The loops are transported by the band 35 as desired, as for example, through the known after-treatment station, or stations, such as the steaming installation. The band 35 of the conveyor 12 is driven by a drive mechanism, (not shown in the drawing), but preferably as a part of the after treatment station, this drive mechanism acting preferably directly on the roller 34 so as to drive the drive gear 33. The belt 7 and band 35, respectively, are guided as slip-free as possible on the rollers 34 and, respectively, 8 and 9 in order to assure synchronized running of the two. This arrangement assures that the yarn 4, which is delivered, free of tension and without stretching to the yarn feed 15 and air transport 17, is guided through the rotating disk 22, and is also looped free of any tension and stretching. The yarn loops 5 formed on the rotating disk 2 are laid out stretch-free in the desired shape and at the desired spacing and even during their transport from the apparatus, the yarn remains free of any additional stress. In addition, the surface of the fixed base plate 1, is provided with a slippery friction free lining, (such as nylon) making sure that the yarn loops 5 can be easily pushed from the space 28 on to the band conveyor 12 without resistance.

During the start up of the apparatus, and as long as no loops 5 exist between the cooperating looping conveyor 6 and the base plate 1, the roller 8 and thus lower run 11, rest on the surface of the base plate 1. The front end of the yarn 4 exiting from the opening 26 onto the surface 27 of the revolving disk 2, is immediately held fast between the lower run 11 and the surface 27 of the disk 2, as a result of which loops are formed without any additional mechanical aids or manual intervention, due to the rotational movement of the disk 2 and the linear movement of the belt 7.

Possible disruptions occurring during the passage of the yarn 4, through the apparatus, can be repaired very easily since the entire conveyor 6 can be swivelled away from the base plate 1 about the axis 10 and accumulations of the yarn 4 can he removed in an area without any difficulty. Even when several devices of this type are arranged one next to the other, the operation of each unit will be simplified and the automatic work process facilitated.

Since the exit opening 26 of the feed channel 25 is located at the periphery of the revolving disk 2, the yarn 4 enters the space between the disk 2 and the first conveyor 6 from below and is laid out in loops 5 on the disk surface. The moving surface of the first conveyor located above the disk, transports the loops with constant speed away from the disk toward the periphery 37 of the fixed base plate 1 so that a continuous series of loops are formed. The newly formed loops are delivered over and over again on the second linear conveyor 12, with each succeeding loop below the preceding one, causing the beginning of the series of loops to stay always on top. The yarn can therefore, be pulled off and removed upward from the second conveyor without any problem and with neither yarn entanglement or other disruption.

Initial looping is made possible by the static friction existing between the surface of the first conveyor 6 and the yarn 4 as the yarn moves over the revolving disk 2. Consequently, the lower surface of belt 7 must be arranged at a distance from the surface 27 of the revolving disk 2 and the base plate 1 in dependence upon the thickness of the yarn 4 and the dislocation of the individual loops 5 in the direction of removal relative to one another. An advantage of the present invention is that the apparatus can adjust itself automatically to changes of the yarn thickness and dislocations of the individual loops relative to one another, so that the required spacing for optimum looping and transport is effected.

In the event of yarn breaks or other disruptions, it is very simple to remove broken yarn and/or parts stuck in the device. Because the yarn is fed in a straight line into the looping device and is not wound around any parts, the first conveyor can be lifted off the loops in a very simple manner making the later, too, easily accessible. Due to the completely automatic start and the simple operation of this device, the latter can be easily installed in conventional production lines, resulting in considerably easier operations.

Various changes and modifications have been shown and discussed and others will be obvious to those skilled in this art. Accordingly, it is intended that the present disclosure be taken as illustrative only and not as limiting of the scope of the present invention.

What is claimed is:

1. Apparatus for the continuous looping of a substantially endless yarn, comprising: a substantially horizontal disk rotatable about a generally vertical axis, having a yarn feed channel extending through said disk and opening onto the upper surface thereof in an angular direction toward the periphery of said disk, and an endless moving planar surface mounted above said disk to bear resiliently toward said disk and moving in a direction radially outward of the periphery of said disk; means for feeding the yarn through said feed channel into the space between said rotatable disk and said moving planar surface, said disk and said planar surface being spaced from each other to engage said yarn; means for regulating the relative speed of said disk and said moving planar surface to cooperate to form a series of successive loops in said yarn, each loop being formed beneath the last preceding loop such that said formed loops may be directly uncoiled in the order of their formation and conveyor means located at least in part beneath the radially outward portion of said planar surface on which the successive loops are deposited in the arrangement as formed.

2. The apparatus according to claim 1, including a fixed base plate having a recess therein, wherein said rotatable disk is located, said rotatable disk having a hole therein in alignment with said yarn feed channel for passage of said yarn and wherein said conveyor means comprises an endless band conveyor extending outwardly from the edge of the base plate and moving in the same direction and at the same speed as the moving planar surface.

3. The apparatus according to claim 2 including means for conjointly moving said endless conveyor and said moving planar surface.

4. The apparatus according to claim 2 including means for adjusting the height of said moving planar surface above said disk.

5. The apparatus according to claim 2 wherein said moving planar surface comprises an endless belt conveyor extending from and running radially with respect to said rotatable disk toward the peripheral edge of said base plate.

6. The apparatus according to claim 5, wherein the lower run of said belt conveyor is spaced from the surface of said base plate and said rotatable disk.

7. The apparatus according to claim 5, including means for mounting said belt conveyor to swivel about the end extending beyond the edge of the base plate and that the inner end rests loosely on the base plate.

8. The apparatus according to claim I, wherein the rotatable disk is mounted on the end of an at least partially hollow bore drive shaft, that the yarn feed channel extends from the lower side of the disk to an opening of the extreme area of the circumference of the upper side of the disk, that said channel is connected by way of an intermediate piece with the bore in the drive shaft and that the bore, intermediate piece and channel form a part of a yarn feed system, including an air nozzle and an air inlet.

9. Method of coiling a continuous yarn into a plurality of loops comprising the steps of feeding said yarn upwardly through a rotary disk to simultaneously engage the upper surface of the disk and a continuous moving surface, pivotally mounted above said disk to bear by its own weight upon the surface of the disk, the moving surface moving in a radially outward direction from the center of the disk and controlling the relative speed of said disk and moving surface so that the engagement of the yarn by the disk and surface causes the yarn to coil into a successive series of loops, each succeeding loop being formed beneath the preceding one and receiving said loops in the successive series so formed and transporting said loops away from said disk.

10. The method according to claim 9 including the step of regulating the force by which said upper surface bears toward said rotating disk to regulate the engagement of said yarn therewith.

11. The method according to claim 9 including the step of withdrawing said yarn coil from between said disk and said moving surface with said loops in a predetermined overlapping arrangement.

* * * * *